US009494116B2

(12) United States Patent
Eisenmenger et al.

(10) Patent No.: US 9,494,116 B2
(45) Date of Patent: Nov. 15, 2016

(54) FUEL INJECTOR AND METHOD FOR THE MANUFACTURE AND/OR ASSEMBLY OF A NOZZLE NEEDLE ASSEMBLY

(75) Inventors: Nadja Eisenmenger, Stuttgart (DE); Hans-Christoph Magel, Reutlingen (DE)

(73) Assignee: Robert Bosch GmbH, Stuttgart (DE)

( * ) Notice: Subject to any disclaimer, the term of this patent is extended or adjusted under 35 U.S.C. 154(b) by 576 days.

(21) Appl. No.: 13/577,696

(22) PCT Filed: Feb. 8, 2011

(86) PCT No.: PCT/EP2011/051778

§ 371 (c)(1),
(2), (4) Date: Aug. 8, 2012

(87) PCT Pub. No.: WO2011/104110

PCT Pub. Date: Sep. 1, 2011

(65) Prior Publication Data

US 2012/0305675 A1 Dec. 6, 2012

(30) Foreign Application Priority Data

Feb. 24, 2010 (DE) ..... 10 2010 002 286
Sep. 10, 2010 (DE) ..... 10 2010 040 581

(51) Int. Cl.
*F02M 51/06* (2006.01)
*F02M 63/00* (2006.01)

(52) U.S. Cl.
CPC ..... *F02M 51/0603* (2013.01); *F02M 63/0026* (2013.01); *F02M 2200/703* (2013.01); *F02M 2200/704* (2013.01); *Y10T 29/494* (2015.01)

(58) Field of Classification Search
CPC ..... B21D 51/16; F02M 63/00; F02M 63/0026; F02M 2200/704; F02M 51/0603; F02M 2200/703
(Continued)

(56) References Cited

U.S. PATENT DOCUMENTS 4,359,032 A * 11/1982 Ohie ..... 123/458
4,448,169 A * 5/1984 Badgley et al. ..... 123/467
(Continued)

FOREIGN PATENT DOCUMENTS

CN 101395366 3/2009
DE 10333573 11/2004
(Continued)

OTHER PUBLICATIONS

PCT/EP2011/051778 International Search Report dated May 26, 2011 (Translation and Original, 8 pages).

*Primary Examiner* — Arthur O Hall
*Assistant Examiner* — Chee-Chong Lee
(74) *Attorney, Agent, or Firm* — Michael Best & Friedrich LLP

(57) ABSTRACT

The invention relates to a fuel injector having a nozzle body (I) and having an injector body (2). In the nozzle body (I) there is formed a high-pressure bore (3) for accommodating a nozzle needle (4) which can perform a stroke movement and via the stroke movement of which at least one injection opening (5) can be opened up or closed off, the fuel injector further including a low pressure chamber (6) coupled to the needle (4) via a coupling device (8) having a first and a second disk-shaped coupler body (9, 10), the low pressure chamber (6) accommodating a piezoelectric actuator (7).

22 Claims, 2 Drawing Sheets

(58) Field of Classification Search
USPC ..... 239/533.2; 29/890.09
See application file for complete search history.

(56) References Cited

U.S. PATENT DOCUMENTS

| | | | | |
|---|---|---|---|---|
| 5,694,903 | A * | 12/1997 | Ganser | 123/496 |
| 5,700,139 | A * | 12/1997 | Rodriguez-Amaya | 417/462 |
| 6,237,570 | B1 * | 5/2001 | Aoki et al. | 123/467 |
| 6,598,591 | B2 * | 7/2003 | Lewis | 123/467 |
| 2006/0243252 | A1 * | 11/2006 | Eisenmenger et al. | 123/447 |
| 2006/0289681 | A1 | 12/2006 | Boecking | |
| 2009/0277978 | A1 | 11/2009 | Matsumoto et al. | |
| 2010/0294242 | A1 * | 11/2010 | Kondo et al. | 123/470 |

FOREIGN PATENT DOCUMENTS

| | | |
|---|---|---|
| DE | 102006022802 | 11/2007 |
| DE | 102007002759 | 7/2008 |
| DE | 102008002417 | 12/2009 |
| DE | 102009002554 | 1/2010 |
| JP | 2008151049 | 7/2008 |
| JP | 2009216022 | 9/2009 |

* cited by examiner

FUEL INJECTOR AND METHOD FOR THE MANUFACTURE AND/OR ASSEMBLY OF A NOZZLE NEEDLE ASSEMBLY

BACKGROUND OF THE INVENTION

The invention concerns a fuel injector for a fuel injection system, in particular a common rail injection system, for injecting fuel into the combustion chamber of an internal combustion engine. The invention furthermore concerns a method for manufacture and/or assembly of a nozzle needle assembly which can be used in particular in such a fuel injector.

A generic fuel injector is disclosed for example in publication DE 10 2008 002 417 A1. The fuel injector described therein comprises a piezoelectric actuator which is accommodated in a relatively pressureless actuator chamber. The piezoelectric actuator is hydraulically coupled to the nozzle needle of the injector such that the nozzle needle assumes its closed position when the piezoelectric actuator is electrically discharged, and transfers to the opening position when the piezoelectric actuator is connected to an electric power source. This means that the opening stroke of the nozzle needle takes place in the opposite direction to the actuator stroke. The coupling device thus achieves a reversal of the movement direction. This has the advantage that the piezoelectric actuator need only be electrically charged during the brief injection phases and is electrically discharged in the longer rest phases of the fuel injector and hence subject to less strain. As a result the life of the piezoelectric actuator provided for activating the nozzle needle is extended. A further measure extending the life of the piezoelectric actuator is the arrangement of the piezoelectric actuator in a relatively pressureless actuator chamber. The actuator is thus not exposed to fuel under high pressure. No high-pressure-resistant seal of the piezoelectric actuator is therefore required.

The device described in the publication for hydraulic coupling of the piezoelectric actuator with the nozzle needle furthermore allows a distance translation between the stroke of the actuator and the stroke of the nozzle needle, in that the cross sections of the two pistons causing the displacement in the coupling device are dimensioned significantly differently. As a result an adequate nozzle needle stroke can be achieved even with a short actuator stroke.

The invention is based on the object of refining a fuel injector of the type described initially in that a greater clearance exists in relation to the surface area design of the coupler pistons to optimize the distance translation. At the same time the structure of the coupling device and the connection of the coupling device to the nozzle needle are simplified to create a simple fuel injector which can be produced at low cost.

SUMMARY OF THE INVENTION

Starting from a generic fuel injector, according to the invention it is proposed that the coupling device comprises a first and second disk-shaped coupler body each with a cylinder bore each accommodating at least one coupler piston delimiting a coupler chamber. The proposed structure of the coupling device with two separate coupler bodies is simple to produce and can therefore be manufactured economically. Also the area ratio of the hydraulically active areas formed on the coupler pistons can be largely freely selected to achieve an optimum distance translation between the actuator stroke and the nozzle needle stroke. For the design of the surface areas, the diameter of the respective cylinder bore can be used in which the respective coupler piston is held. The diameter of the cylinder bore can also be freely selected. With the coupling device, with corresponding arrangement of coupler pistons in the coupler bodies, also a movement reversal can be achieved so that the nozzle needle stroke takes place in the opposite direction to the actuator stroke. This guarantees that the piezoelectric actuator need only be electrically charged to perform an injection, while it is electrically discharged in the phases between two injection processes. As a result the piezoelectric actuator is subject to less strain. In this context it is also favorable that the piezoelectric actuator is arranged in a low-pressure chamber. The piezoelectric actuator can be designed as a "wet" or a "dry" actuator, wherein in the latter case the actuator has a corresponding seal consisting for example of a metal sleeve with a membrane.

Preferably the first and second disk-shaped coupler bodies are arranged lying behind each other in the axial direction between the nozzle body and the injector body. The two disk-shaped coupler bodies thus form housing parts which separate the low-pressure region from the high-pressure region. Furthermore the coupling construction is simple and easy to assemble, and also compact in the axial direction.

To simplify the construction further, it is furthermore proposed that the first disk-shaped coupler body axially delimits the high-pressure bore formed in the nozzle body. Alternatively or additionally it may be proposed that the second disk-shaped coupler body axially delimits the low-pressure chamber formed in the injector body. Thus the coupling device not only separates the low-pressure region from the high-pressure region but also seals the low-pressure region against the high-pressure region. No additional sealing measures are required so that simple and economic manufacture of the injector is guaranteed.

According to a preferred embodiment of the invention, a connecting piston is formed on the nozzle needle for mechanical connection of the nozzle needle with the first coupler piston held in the first disk-shaped coupler body. The connecting piston is here guided through a guide bore formed in the coupler body. The connecting piston thus extends the nozzle needle into the low-pressure region. The mechanical connection of the connecting piston with the coupler piston can take place for example by welding and/or by press connection.

The connecting piston is guided through the guide bore and through the first coupler chamber at least as far as the first coupler piston. As a result a pressure area formed on the first coupler piston and delimiting the first coupler chamber is reduced by the cross section area of the connecting piston. The necessary needle opening force can thus be reduced via the design of the respective area ratios so that the needle dynamics increase. Also the necessary actuating forces are reduced so that a less powerful actuator can be used.

To seal the guide bore in the first coupler body, which holds the connecting piston formed on the nozzle needle, against the high-pressure bore, the connecting piston can be surrounded in the region of the high-pressure bore by a sleeve lying tightly against the first disk-shaped coupler body. Instead of a separate sealing sleeve, the first coupler body can also be fitted with a cylindrical shoulder to guide the connecting piston and seal the guide bore against the high-pressure bore.

As a refinement it is proposed that the guide bore comprises a low-pressure region for example in the form of a ring groove which is connected via a bore with the low-pressure chamber. This has the advantage that fuel reaching the guide bore due to a leak can be diverted to the low-pressure chamber via the low-pressure region and the bore. The leakage diversion ensures a defined coupler chamber pressure.

To achieve a hydraulic coupling of the nozzle needle with the piezoelectric actuator, the coupler chambers are hydraulically connected via bores in the disk-shaped coupler bodies. If the volume of a coupler chamber changes because of the stroke of a coupler piston held therein, fuel is displaced via the connecting bores from one coupler chamber to the other coupler chamber. Depending on the respective area ratio of the hydraulically active surfaces delimiting the coupler chambers at the respective coupler pistons, a distance translation is achieved. The nozzle needle stroke necessary to clear the injection opening can consequently be achieved even with a short actuator stroke. To improve the hydraulic design a choke is formed preferably in one of the bores connecting the two coupler chambers. The choke causes a damping of the needle speed and a reduction in the characteristic curve gradient.

According to a preferred embodiment of the invention the high-pressure bore formed in the nozzle body has a guide region to guide the nozzle needle. The regions of the high-pressure bore adjacent to the guide region are preferably connected hydraulically via a choke. With this measure the closing speed of the nozzle needle can be optimized. The closing movement of the nozzle needle is here achieved by a closing spring supported on the nozzle needle.

In addition it can be provided that closing forces are also generated by the coupling device. As a refinement it is therefore proposed that the low-pressure chamber is connected with a return circuit via a non-return valve to achieve a pressure rise in the low-pressure chamber. A pressure rise to around 150 bar for example has been found to be sufficient.

According to a further preferred embodiment, as an alternative to a connecting piston formed directly on the nozzle needle, it is proposed that the nozzle needle and the first piston coupler piston held in the first disk-shaped coupler body are coupled together mechanically via a connecting piston which is guided as part of the first coupler piston through a guide bore formed in the coupler body. This means that the connecting piston need not necessarily be part of the nozzle needle but can also be part of the first coupler piston if it is guided through the guide bore on assembly of the injector. For example the connecting piston can be formed as one piece with the first coupler piston or be connected with this such that in a first assembly step the unit, designed as a one-piece unit or constructed from a first coupler piston and connecting piston, is inserted in the guide bore of the coupler body, and then in a second assembly step the connecting piston is connected to the nozzle needle. This has the advantage that the mechanical connecting point is moved from the low-pressure region to the high-pressure region. Problems of fit in the piston guides which can be caused for example by distortions on welding or compression are thus avoided or shifted to a less delicate region. If the high-pressure region is sealed from the low-pressure region via a separate sealing sleeve lying on the first coupler body, it must be ensured that the sealing sleeve is applied before connection of the connecting piston to the nozzle needle.

Further preferably the connecting piston is connected with the nozzle needle and/or the first coupler piston by force, material and/or form fit. As already mentioned, the connection can take place by welding or pressing. Also a screw connection can be provided. Preferably then at least one end segment of the connecting piston has an external thread and can be inserted in a bore with an internal thread formed in the first piston and/or nozzle needle.

Furthermore the connecting piston can also be indirectly connected with the nozzle needle via a connecting piece. The connecting piece preferably has the same outside diameter as the nozzle needle and is attached axially to the nozzle needle. The connection can take place for example by welding. To accommodate the connecting piece, in the connecting piece can be made a bore, in particular a blind bore, in which an end segment of the connecting piston is inserted. With corresponding choice of diameter, the connection can be a press connection. Alternatively a screw connection or weld connection is feasible.

The object of the invention is furthermore a method for production and/or assembly of a nozzle needle assembly for a fuel injector which comprises a nozzle needle, a coupler piston and a connecting piston, wherein the connecting piston has a smaller outer diameter than the coupler piston and/or the nozzle needle and is part of a one-piece or multi-piece coupler piston. In this method first the connecting piston is guided through a guide bore of a coupler body and then directly or indirectly connected with the nozzle needle by force, material and/or form fit. The method leads to a nozzle needle assembly which can be used particularly advantageously in a fuel injector according to the invention. The nozzle needle assembly is furthermore also suitable for use in a modified design and consequently is not restricted to use in an injector according to the invention.

Preferably the connecting piston with nozzle needle and/or connecting piece for indirect connection of the connecting piece with the nozzle needle is welded, soldered, pressed, screwed and/or glued.

If the connecting piston is connected to the nozzle needle indirectly via a connecting piece, further preferably the connecting piece and the nozzle needle are butt-joined and welded together.

BRIEF DESCRIPTION OF THE DRAWINGS

Preferred embodiments of the invention are explained in more detail below with reference to the enclosed drawings. These show.

DETAILED DESCRIPTION

Figure 1:
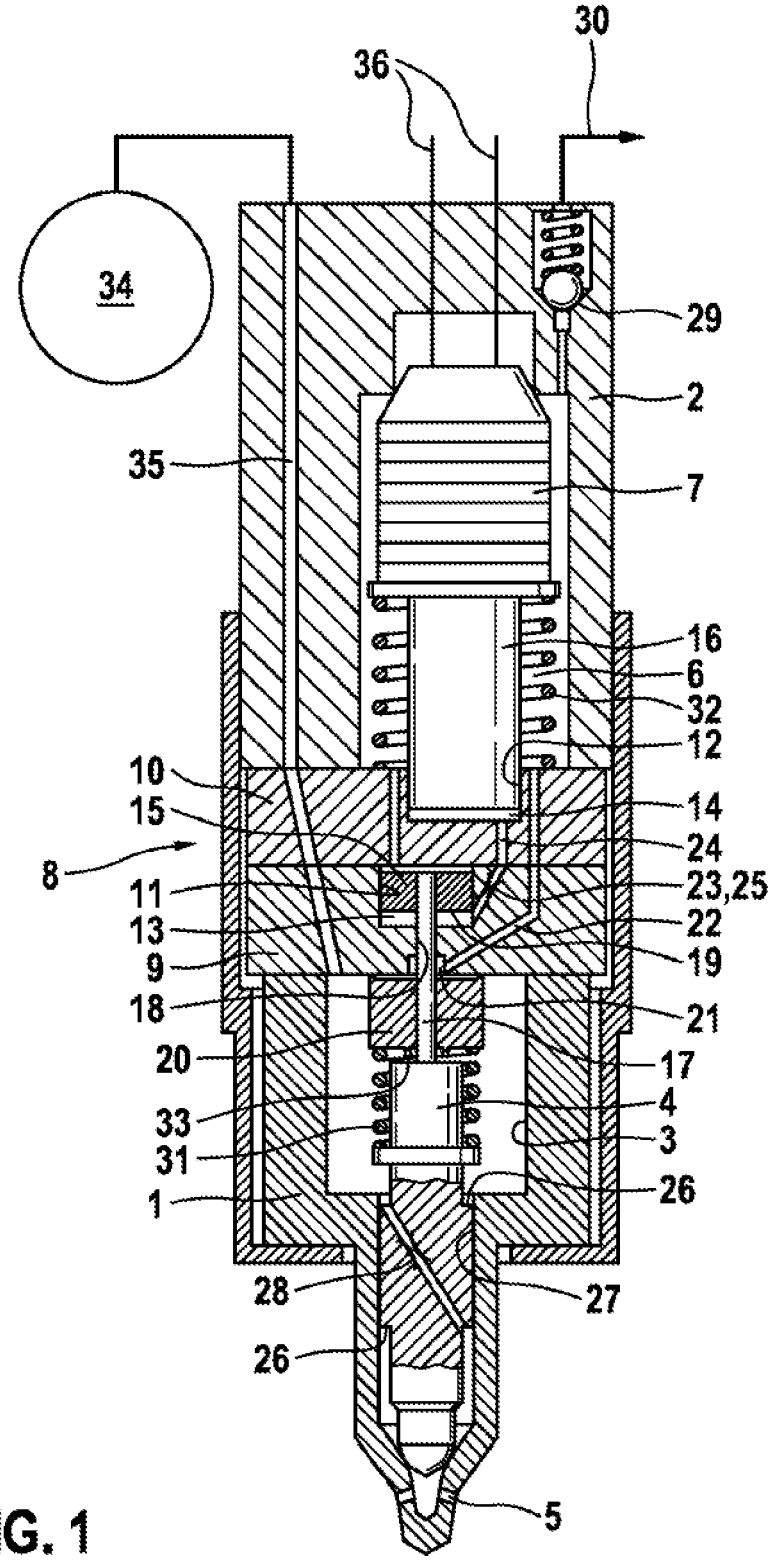
FIG. 1—a longitudinal section through a first fuel injector according to the invention, and FIG. 2—a longitudinal section through a second fuel injector according to the invention.

The fuel injector shown in longitudinal section in FIG. 1 has a nozzle body 1 to accommodate a nozzle needle 4 and an injector body 2 to accommodate a piezoelectric actuator 7 to activate the nozzle needle 4. The nozzle needle 4 is held mobile in a stroke movement in a high-pressure bore 3 of the nozzle body 1 so that via the nozzle needle stroke at least one injection opening 5 formed in the nozzle body 1 can be opened or closed. When the nozzle needle 4 is in its open position, fuel under high pressure is injected via the at least one injection opening 5 into the combustion chamber of the internal combustion engine. The fuel is supplied to the fuel injector from a high-pressure accumulator 34, in the present case from a common rail. For this in the injector body 2 is formed a supply channel 35 via which the fuel enters the high-pressure bore 3 and hence reaches at least one injection opening 5.

To activate the nozzle needle 4 the piezoelectric actuator 7 can be connected via electrical connections 36 with an electrical voltage source (not shown). When the piezoelectric actuator 7 is electrically charged, this undergoes a length expansion constituting the actuator stroke which is converted into a stroke movement of the nozzle needle 4 because of the coupling device 8. The present coupling device 8 is designed such that a length extension of the piezoelectric actuator 7 causes a movement of the nozzle needle 4 opposite the movement direction of the piezoelectric actuator 7. This means that the piezoelectric actuator 7 is electrically charged on the opening stroke of the nozzle needle 4 while it is discharged between two injection processes or in the closed position of nozzle needle 4. This reduces the strain on the piezoelectric actuator 7.

It is also favorable for the life of the piezoelectric actuator 7 that this is accommodated in the low-pressure chamber 6 of the injector body 2. The piezoelectric actuator 7 is consequently not exposed to high pressure.

Said coupling device 8 has two disk-shaped coupler bodies 9, 10 which are arranged lying behind each other in the axial direction between the injector body 2 and the nozzle body 1. The two disk-shaped coupler bodies 9, 10 thus separate a low-pressure region allocated to the injector body 2 from a high-pressure region allocated to the nozzle body 1. At the same time the disk-shaped coupler body 9 lying on the nozzle body 1 seals the high-pressure bore 3, and the disk-shaped body 10 lying on an injector body 2 seals the low-pressure chamber 6. The coupling device 8 can thus be shifted completely into the low-pressure region.

In both disk-shaped coupler bodies 9, 10 is formed a cylinder bore 11, 12 which each accommodate a coupler piston 15, 16, wherein each coupler piston 15, 16 axially delimits a coupler chamber 13, 14 within the respective cylinder bore 11, 12. The coupler piston surface areas delimiting the respective coupler chambers 13, 14 form pressure areas, the area ratio of which determines the translation ratio between the actuator stroke and the needle stroke. In the present case a significantly larger pressure area is formed on the second coupler piston 16 allocated to the piezoelectric actuator 7 to delimit the second coupler chamber 14 than on the first coupler piston 15 which is connected via a connecting piston 17 with the nozzle needle 4. The connecting piston 17 for this is guided through a guide bore 18 in the first disk-shaped coupler body 9 and through the first coupler chamber 13 so that the pressure area 19 delimiting the coupler chamber 13 on the first coupler piston 15 is reduced by the cross-section area of the connecting piston 17. Because the first coupler chamber 13 is arranged between the nozzle needle 4 and the first coupler piston 15, a pressure rise in the first coupler chamber 13 causes the first coupler piston 15 and hence the nozzle needle 4 to be raised. The pressure in the first coupler chamber 13 rises when, because of the length expansion of the piezoelectric actuator 7, the second coupler piston 16 is immersed more deeply into the second coupler chamber 14 and thus displaces fuel. Via bores 23, 24 and a choke 25 formed herein, the fuel displaced from the second coupler chamber 14 then enters the first coupler chamber 13. Because of the area ratio selected i.e. the size of the hydraulically active area formed on a coupler piston 15, 16, a relatively short actuator stroke can achieve a significantly longer nozzle needle stroke to open the at least one injection opening 5. The choke 25 formed in the bore 23 or 24 causes a damping of the needle speed, further improving the hydraulic design.

To seal the guide bore 18 against the high-pressure bore 3, the connecting piston 17 is surrounded by a sleeve 20 in the region of the high-pressure bore 3. The sleeve 20 is furthermore supported on the first disk-shaped coupler body 9. For this the sleeve 20 on the face has a supporting surface formed as a sharp edge. Via a closing spring 31 supported on the nozzle needle 4, the sleeve 20 is held in contact with the disk-shaped coupler body 9. The closing spring 31 also ensures that the nozzle needle 4 assumes its closed position when piezoelectric actuator 7 is discharged. Insofar as the arrangement of the sleeve 20 around the connecting piston 17 cannot prevent a leakage in the region of the guide bore 18, a leakage quantity entering the guide bore 18 is diverted to a return circuit 30 via a ring groove 21 and a bore 22 which connects the ring groove 21 with the low-pressure chamber 6. In this way a defined coupler chamber pressure is ensured. Between the return circuit 30 and the low-pressure chamber 6 can be arranged—as in the present case—a non-return valve 29 which allows a pressure rise in the low-pressure chamber 6. By increasing the fuel pressure in the low-pressure chamber 6 for example to 150 bar, via the coupling device 8 closing forces can also be achieved to allow support of a closing movement of the nozzle needle 4.

In the low-pressure chamber 6 is also arranged a pretensioned spring 32, by means of which the piezoelectric actuator 7 is pretensioned against the injector housing 2.

For further optimization of the closing movement of the nozzle needle 4, the fuel injector shown has a guide region 27 formed in the high-pressure bore 3 to guide the nozzle needle 4. The regions of the high-pressure bore 3 adjacent to the guide region 27 are hydraulically connected via a choke 28. The choke 28 has a damping effect on the movement of the nozzle needle 4. The nozzle needle 4 also has a enlarged diameter in the guide region 27 forming radially running shoulders 26 to constitute a pressure step.

Furthermore a needle stop 33 is provided to delimit the nozzle needle stroke, which in the present case is formed on the end of the sleeve 20 facing the nozzle needle 4. Instead of being arranged in the high-pressure region, the needle stop 33 can also be arranged in the low-pressure region.

Figure 2:
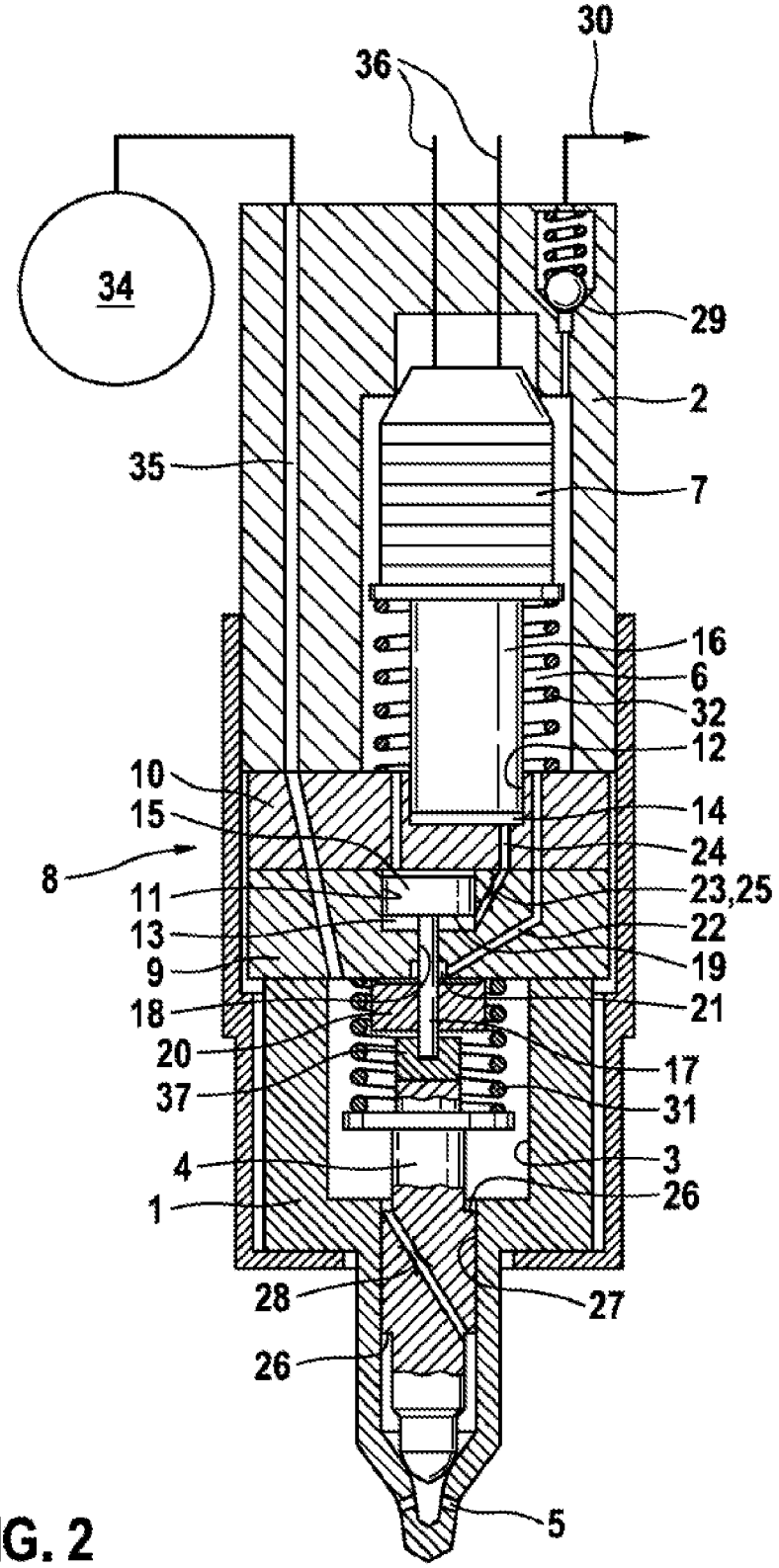

The embodiment of a fuel injector according to the invention shown in FIG. 2 differs essentially from that in FIG. 1 in that the connecting piston 17, by means of which the nozzle needle 4 and first coupler piston 15 are mechanically coupled, is part of the coupler piston 15. On assembly of the injector the connecting piston 17 and the first coupler piston 15 are inserted in the guide bore 18 as an assembled unit. This means that the connecting piston 17 is first connected, in the present case welded, with the coupler piston 15 and then guided through the guide bore 18. The sleeve 20 is then placed on the end of the connecting piston 17 passed through the guide and seals the high-pressure region against the low-pressure region. Only then is the nozzle needle 4 with connecting piece 37 applied and welded to the connecting piston. The connecting piece 37 forms a unit with the nozzle needle 4 wherein the connecting piece 37 and nozzle needle 4 can also be designed or constructed of one piece. In the present case the connecting piece 37 is placed axially on the nozzle needle 4 and welded to this.

With regard to function method, the fuel injector shown in FIG. 2 does not differ from that in FIG. 1 so that in this connection reference is made to the previous statements. The alternative embodiment shown in FIG. 2 substantially facilitates assembly of the fuel injector according to the invention and hence lowers production costs. Also the risk of poor fit in the guide regions is reduced as the mechanical connecting parts are shifted from the low-pressure region to the high-pressure region. Any distortions of the connecting piston 17 caused by welding or pressing are of secondary importance in the region of the high-pressure bore 3 so arrangement of the mechanical connecting point in this region has proved advantageous.

What is claimed is:

1. A fuel injector for a fuel injection system, the fuel injector having a nozzle body (1) and an injector body (2), wherein in the nozzle body (1) is formed a high-pressure bore (3) to accommodate a stroke-mobile nozzle needle (4), via a stroke movement of which an injection opening (5) can be opened or closed, and wherein in the injector body (2) is formed a low-pressure chamber (6) to accommodate a piezoelectric actuator (7) which via a coupling device (8) is hydraulically coupled or decoupled with the nozzle needle (4) such that the nozzle needle (4) opens the injection opening (5) when the piezoelectric actuator (7) is electrically charged, characterized in that the coupling device (8) comprises a first and a second disk-shaped coupler body (9, 10) each with a cylinder bore (11, 12), each cylinder bore (11, 12) defining a cylinder bore interior volume, each cylinder bore (11, 12) accommodating a coupler piston (15, 16) delimiting a coupler chamber (13, 14) within the cylinder bore interior volume of the cylinder bore (11, 12), such that each coupler chamber (13, 14) is disposed entirely within the cylinder bore interior volume of one of the cylinder bores (11, 12), wherein a connecting piston (17) is provided for mechanical connection of the nozzle needle (4) with the coupler piston (15) accommodated in the first disk-shaped coupler body (9), wherein the connecting piston (17) slides within a guide bore (18) formed in the first disk-shaped coupler body (9), the guide bore (18) defining a guide bore (18) interior volume such that the connecting piston (17) slides within the guide bore (18) interior volume, and wherein the guide bore (18) opens into the coupler chamber (13) of the first disk-shaped coupler body (9), the guide bore (18) being disposed axially between the nozzle needle 4 and the coupler chamber (13) of the first disk-shaped coupler body (9).

2. The fuel injector as claimed in claim 1, characterized in that the first and second disk-shaped coupler bodies (9, 10) are arranged lying behind each other in the axial direction between the nozzle body (1) and the injector body (2).

3. The fuel injector according to claim 1, characterized in that the first disk-shaped coupler body (9) delimits the high-pressure bore (3) axially and/or the second disk-shaped coupler body (10) delimits the low-pressure chamber (6) axially.

4. The fuel injector as claimed in claim 1, characterized in that the connecting piston (17) is guided through the coupler chamber (13) of the first disk-shaped coupler body (9) at least up to the coupler piston (15) of the first disk-shaped coupler body (9) so that a pressure area (19) formed on the coupler piston (15) of the first disk-shaped coupler body (9) and delimiting one of the coupler chambers (13) is reduced by a cross section area of the connecting piston (17).

5. The fuel injector as claimed in claim 1, characterized in that the connecting piston (17) in a region of the high-pressure bore (3) is surrounded by a sleeve (20) that seals against the first disk-shaped coupler body (9).

6. The fuel injector of claim 5, wherein the sleeve (20) and the coupler piston (15) of the first disk-shaped coupler body (9) are coupled to opposite ends of the connecting piston (17).

7. The fuel injector as claimed in claim 1, characterized in that the guide bore (18) comprises a low-pressure region which is in connection with the low-pressure chamber (6) via a further bore (22).

8. The fuel injector as claimed in claim 7, characterized in that the low-pressure region is a ring groove (21), which is in connection with the low-pressure chamber (6) via the further bore (22).

9. The fuel injector as claimed in claim 7, wherein the further bore (22) extends through both the first and the second disk-shaped coupler bodies (9, 10).

10. The fuel injector as claimed in claim 1, characterized in that the coupler chambers (13, 14) are hydraulically connected via connection bores (23, 24) formed in the disk-shaped coupler bodies (9, 10), wherein a choke (25) is formed in one of the connection bores (23, 24).

11. The fuel injector as claimed in claim 1, characterized in that the high-pressure bore (3) comprises a guide region (27) to guide the nozzle needle (4), wherein regions of the high-pressure bore adjacent to the guide region (27) are hydraulically connected via a choke (28).

12. The fuel injector as claimed in claim 1, characterized in that the low-pressure chamber (6) is connected with a return circuit (30) via a non-return valve (29) in order to create a pressure rise in the low-pressure chamber (6).

13. The fuel injector as claimed in claim 1, characterized in that the nozzle needle (4) and the coupler piston (15) accommodated in the first disk-shaped coupler body (9) are mechanically coupled via the connecting piston (17) which is guided as part of the coupler piston (15) through the guide bore (18).

14. The fuel injector as claimed in claim 13, characterized in that the connecting piston (17) is connected with the nozzle needle (4) and/or the coupler piston (15) by force, material and/or form fit.

15. The fuel injector as claimed in claim 1, wherein the fuel injector is for a common rail injection system.

16. The fuel injector according to claim 1, characterized in that the first disk-shaped coupler body (9) delimits the high-pressure bore (3) axially.

17. The fuel injector according to claim 1, characterized in that the second disk-shaped coupler body (10) delimits the low-pressure chamber (6) axially.

18. The fuel injector as claimed in claim 1, wherein the connecting piston (17) is formed as part of the nozzle needle (4).

19. The fuel injector of claim 1, wherein the piezoelectric actuator (7) is disposed outside of the two disk-shaped coupler bodies (9, 10).

20. The fuel injector of claim 1, wherein the coupler piston (15), the connecting piston (17), and the nozzle needle (4) are configured to move together within the fuel injector.

21. A fuel injector for a fuel injection system, the fuel injector having a nozzle body (1) and an injector body (2), wherein in the nozzle body (1) is formed a high-pressure bore (3) to accommodate a stroke-mobile nozzle needle (4), via a stroke movement of which an injection opening (5) can be opened or closed, and wherein in the injector body (2) is formed a low-pressure chamber (6) to accommodate a piezoelectric actuator (7) via which a coupling device (8) is hydraulically coupled or decoupled with the nozzle needle (4) such that the nozzle needle (4) opens the injection opening (5) when the piezoelectric actuator (7) is electrically charged, wherein the coupling device (8) includes a first and a second disk-shaped coupler body (9, 10) each with a cylinder bore (11, 12), each cylinder bore (11, 12) accommodating a coupler piston (15, 16) delimiting a coupler chamber (13, 14) within each coupler bore (11, 12), and wherein when the piezoelectric actuator (7) is charged, at least a portion of the piezoelectric actuator (7) is configured to extend toward the opening (5), causing fluid to move into the coupler chamber (13) of the first disk-shaped coupler body (9) and to contact a lower surface of the coupler piston (15) of the first disk-shaped coupler body (9) and raise the coupler piston (15) of the first disk-shaped coupler body (9), thereby raising the nozzle needle (4).

22. The fuel injector of claim 21, wherein the piezoelectric actuator (7) is disposed outside of the two disk-shaped coupler bodies (9, 10).

* * * * *